US008141682B2

(12) United States Patent
White

(10) Patent No.: US 8,141,682 B2
(45) Date of Patent: Mar. 27, 2012

(54) SECURITY CONE-DOOR FOR A LADDER

(76) Inventor: Ronald E. White, Newport Beach, CA (US)

( * ) Notice: Subject to any disclaimer, the term of this patent is extended or adjusted under 35 U.S.C. 154(b) by 185 days.

(21) Appl. No.: 12/462,389

(22) Filed: Aug. 3, 2009

(65) Prior Publication Data

US 2010/0025150 A1 Feb. 4, 2010

Related U.S. Application Data

(63) Continuation of application No. 11/499,207, filed on Aug. 4, 2006, now abandoned.

(51) Int. Cl.
*E06C 7/00* (2006.01)

(52) U.S. Cl. ..... 182/106; 182/93

(58) Field of Classification Search ..... 182/106, 182/93

See application file for complete search history.

(56) References Cited

U.S. PATENT DOCUMENTS

| | | | | |
|---|---|---|---|---|
| 347,608 | A * | 8/1886 | Jackson | 182/194 |
| 2,381,569 | A * | 8/1945 | Bowman | 182/77 |
| 5,347,769 | A * | 9/1994 | Dinsmore | 52/101 |
| 5,393,106 | A * | 2/1995 | Schroeder | 285/136.1 |
| 6,779,311 | B2 * | 8/2004 | Roberts | 52/101 |

* cited by examiner

*Primary Examiner* — Alvin Chin Shue
(74) *Attorney, Agent, or Firm* — Roger C. Turner

(57) ABSTRACT

A first embodiment of the security apparatus comprises a retaining collar; a plurality of segments forming a generally frusta-conical enclosure, with one or more of the segments having an access opening therein; and a lockable access door covering the opening. The retaining collar is separable into portions that conforms to the shape of the periphery and are coupled together around the structure. The segments have an upper portion that attaches to the collar; and have a bottom portion that extends radically downwardly from the collar at an angle of about 30 degree; with the radial edges interconnected forming the enclosure.

A second embodiment of the apparatus secures a ladder supported on a wall and a retaining bar; a plurality of segments forming a generally semi-frusta-conical enclosure, with one or more of the segments having an access opening therein; and a lockable access door covering the opening.

7 Claims, 3 Drawing Sheets

SECURITY CONE-DOOR FOR A LADDER

This is a continuation of prior application Ser. No. 11/499,207 filed Aug. 4, 2006 now abandoned.

BACKGROUND OF THE INVENTION

The invention relates to a security apparatus for a ladder; particularly to a frusta-conical enclosure for a ladder having a door for authorized access.

Billboards, freeway and highway information signs, etc., are typically supported on steel columns having a ladder attached to one of the columns for access up to service the sign and property. These signs and property have become targets for unauthorized persons to climb the ladder to perform graffiti, vandalism, pranks, etc., on the signs and property. There have been numerous attempts to block access to the elevated signs and property, including fences at the base of the ladder, the ladder being elevated on the support structure, a ladder guard with a lockable cover over several rungs of the ladder, and some have added barbed wire and razor wire around portions of the ladder to try to block and discourage access to the ladder by unauthorized persons.

Most of the blocking devices are not successful, and young, athletic persons can frequently jump or climb around such devices to utilize the ladder. For those that are successful, the security device makes it also very difficult for an authorized person to remove the obstruction to access the ladder.

Many ladders are also attached to the outer wall of a building for access to the upper area of the building. There is also elevated indoor property, particularly in industrial and manufacturing facilities, having supported ladders that require only authorized access. These ladders are also attractive for use by unauthorized persons. A security apparatus is also needed for such ladders.

In view of the foregoing, it is an object of the present invention to provide a security apparatus for a ladder that is very effective at denying access to unauthorized persons, but allows the ladder to be readily accessible to an authorized person.

It is another object to provide a security apparatus that is adaptable for various structures that may support the ladder that is inexpensive to fabricate, easy to assemble and install, durable and having a long life.

SUMMARY OF THE INVENTION

The foregoing objects are accomplished by an improved security apparatus for blocking unauthorized access to a ladder that is supported on a column type structure. A first embodiment of the apparatus comprises a retaining collar, a plurality of segments forming a generally frusta-conical enclosure. One or more of the segments has an access opening therein; and the enclosure has a lockable access door covering the opening.

The retaining collar conforms to the shape of the periphery of the structure and is separable into portions having couplings thereon for attaching the collar to the structure. The coupling has a plurality of flanges extending radially and downwardly and has apertures therein for retaining the enclosure.

The plurality of frusta-conical segments each have an upper portion, a bottom portion and radial edges. The upper portion conforms to the respective shape of the collar and is attachable to the flanges of the collar with suitable fasteners. The bottom portions extends radially downwardly from the collar at an angle ranging from about 25 to about 45 degrees, with each segment interconnectable along the adjacent radial edges thereof forming the frusta-conical enclosure around the structure and the ladder.

At least one of the segments (two adjacent segments) of the enclosure has an opening therein for providing clearance for the ladder and providing clearance for a person to access the ladder. The access door covers the opening providing clearance for a person, and has a lockable mechanism thereon for securing the door to the frusta-conical enclosure.

A second embodiment of the improved security apparatus is also provided for a ladder that is supported on a wall type structure. The second embodiment of the apparatus comprises a retaining bar; a plurality of segments forming a generally semi-frusta-conical enclosure, with one or more of the segments having an access opening therein; and a lockable access door covering the opening.

The retaining bar has a vertical flange thereon for attaching the bar to the wall structure, and has a flange extending downwardly at an angle of about 25-45 degrees for retaining the segments of the enclosure.

The plurality of frusta-conical segments each has an upper portion, a bottom portion and radial edges. The upper portion has a shape conforming to the respective flat surface of the retaining bar and is attachable to the retaining bar. Each bottom portion extends radially downwardly from the bar at an angle ranging from about 25 to about 45 degrees, with each segment interconnectable along the adjacent radial edges thereof forming the semi-frusta-conical enclosure around the structure and the ladder.

At least one of the segments (or two adjacent segments) of the assembled enclosure has an opening therein for providing clearance for the ladder and providing clearance for a person to access the ladder. An access door is provided on the enclosure to cover the opening, and has a lockable mechanism thereon for securing the door to the enclosure.

BRIEF DESCRIPTION OF THE DRAWINGS

While the novel features of the invention are set forth in the appended claims, the invention will be better understood along with other features thereof from the following detailed description taken in conjunction with the drawings, in which:

DETAILED DESCRIPTION OF THE INVENTION

Figure 1:
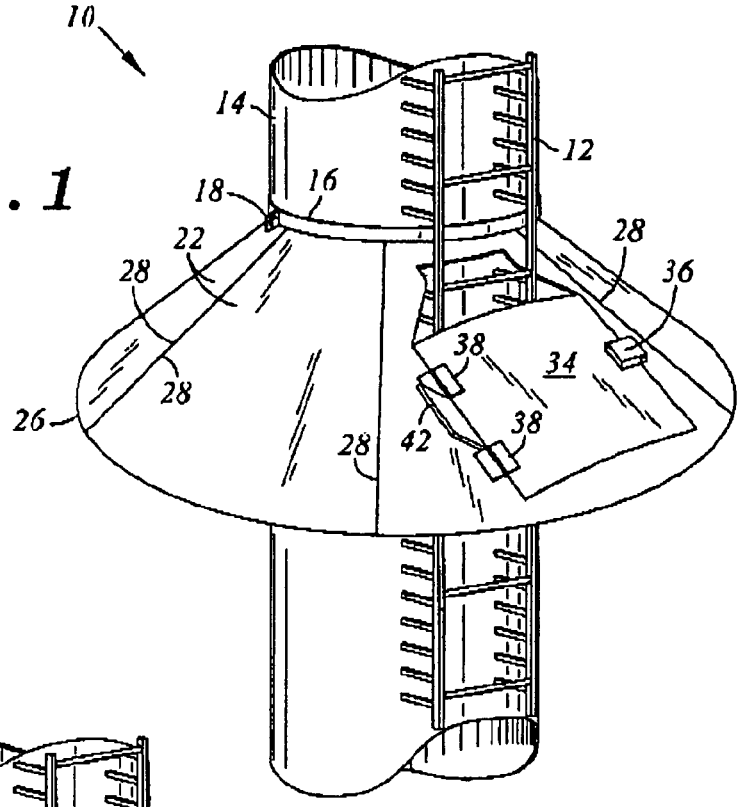
FIG. 1 is a front perspective view of the security cone-door installed around a ladder supported by a cylindrical structure and having the cone-door locked to deny unauthorized access to the ladder.
Figure 2:
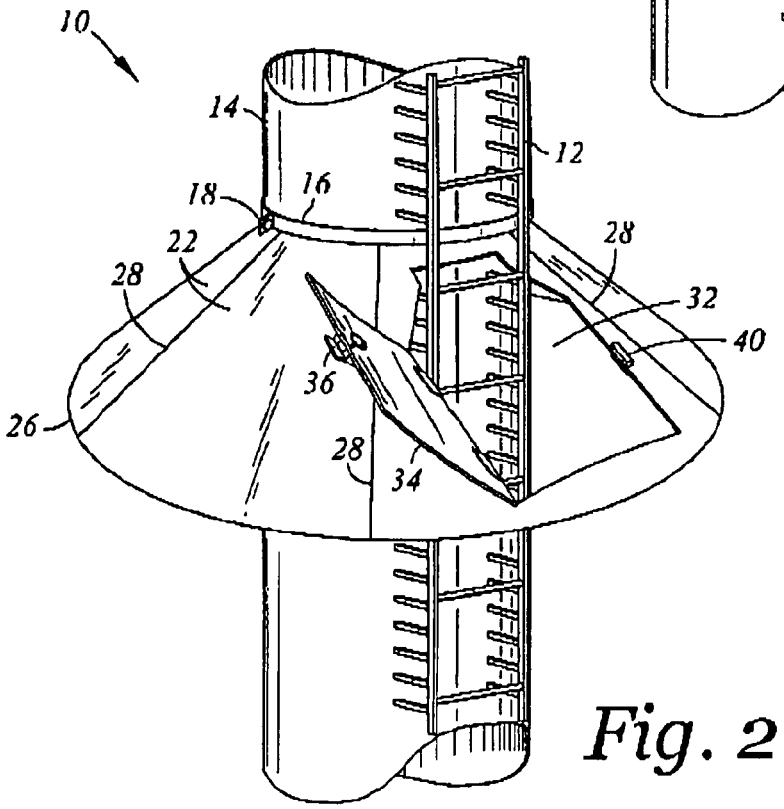
FIG. 2 is a front perspective view of the security cone-door of FIG. 1, having the cone-door opened for authorized access to the ladder.
Figure 3:
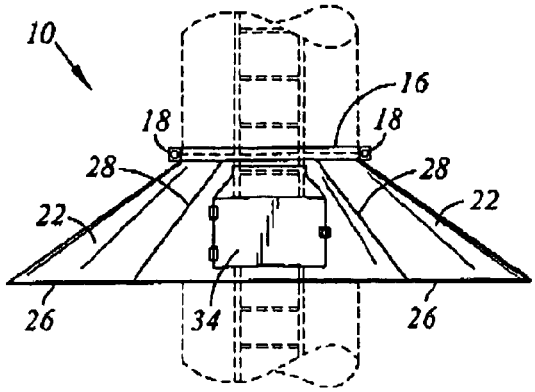
FIG. 3 is a front elevational view of the cone-door of the present invention.
Figure 4:
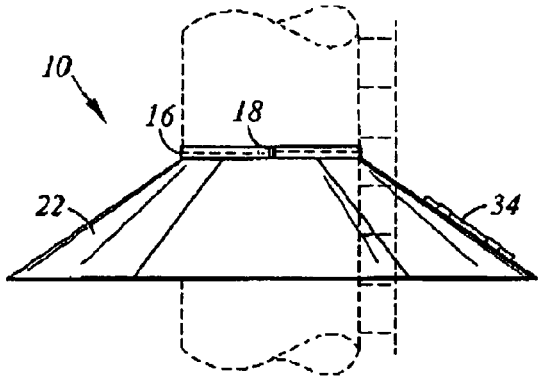
FIG. 4 is a side elevational view of the cone-door of the present invention.
Figure 5:
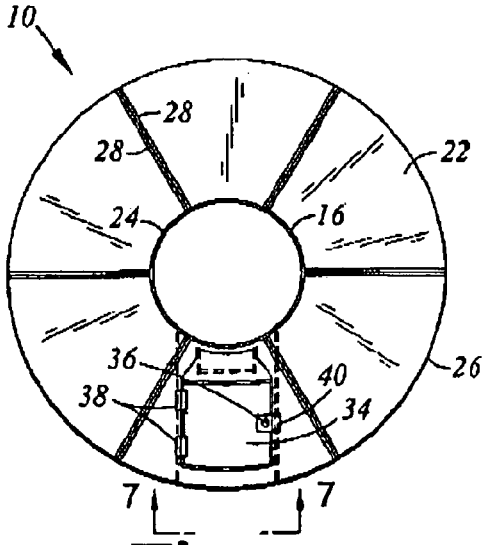
FIG. 5 is a top plan view of the cone-door of the present invention.
Figure 6:
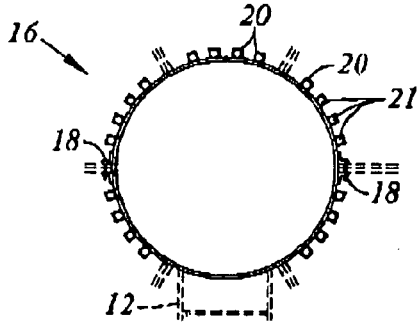
FIG. 6 is a top plan view of the collar at the upper end of the cone-door.

Referring first to FIGS. 1-6, there is shown an example of a preferred embodiment of the security cone-door apparatus 10 of the present invention. A ladder 12 is shown supported on a typical structure 14 that is shown as a steel cylindrical pipe which can range from about 12 to about 48 inches in diameter. The supporting structure 14 may be one of several supports that may provide the base for a large heavy billboard, highway information sign or other elevated property. The cylindrical pipe naturally has a generally cylindrical periphery. The base of other supporting structure 14 for the ladder may alternatively be in the form of a rectangular cross section or "I" beam having a generally rectangular periphery.

The security apparatus includes a retaining collar 16 conforming to the shape of the periphery of the supporting structure 14 for attaching and retaining the apparatus to the supporting structure. In the current example (see FIG. 6), the supporting structure is cylindrical and the collar is therefore generally cylindrical. The collar needs to be separable to be fitted around the periphery of the structure, and can have a single separation than can be expanded around the structure then compressed and coupled together. Preferably the collar is formed in two or more portions of 10 gage steel having mating coupling flanges 18 that can be bolted together to secure the collar to the structure. The collar also preferably includes a plurality of flanges 20 having apertures 21 therein and extending radially outward and downwardly at an angle therefrom.

For rectangular and I beam structures, the collar can be in the form of rectangular portions, or the collar can be circular having inward flanges conforming to the periphery of the structure.

The "cone" of the apparatus is provided by a plurality of frusta-conical segments 22 each having an upper portion 24, a bottom portion 26 and radial edges 28. The segments are suitably fabricated from about 10 to about 18 gage galvanize sheet metal, and can be assembled by typical sheet metal methods and fasteners. The upper portions have an arcuate shape corresponding to the shape of the collar and include suitable fasteners for attaching the segments to the apertures 21 in the respective flanges 20 of the collar. (The means for attaching the upper portions of the segments to the collar can alternatively be provided by flanges extended from the upper portion of the segments that are attachable to or under the respective portions of the retaining collar.) The segments are interconnected along their adjacent radial edges 28 forming a generally frusta-conical enclosure around the structure 14 and the ladder 12. Such interconnections are preferably along the outer (upper) surface of the segments to protect them from disassembly by someone from the ladder below.

The segments of the enclosure extend radially downwardly from the collar at an angle ranging from about 25 to about 45 degrees, preferably at about 30 degrees. The bottom portions of the segments extend a suitable distance (beyond the reach of an unauthorized intruder) of about four feet beyond the ladder, resulting in a frusto-conical enclosure having a greater diameter of about 10 to 12 feet.

At least one of the segments (or two adjacent-segments) 22 of the assembled enclosure has an opening 32 (see FIG. 2) therein for providing clearance for the ladder 12 and providing clearance for a person to access the ladder. The opening is typically rectangular in shape and provides ample clearance around the ladder and clearance for the hands, feet, and body movements for a person to pass up and down the ladder through the opening. The actual dimensions are typically controlled by OSHA regulations and standards.

Figure 7:
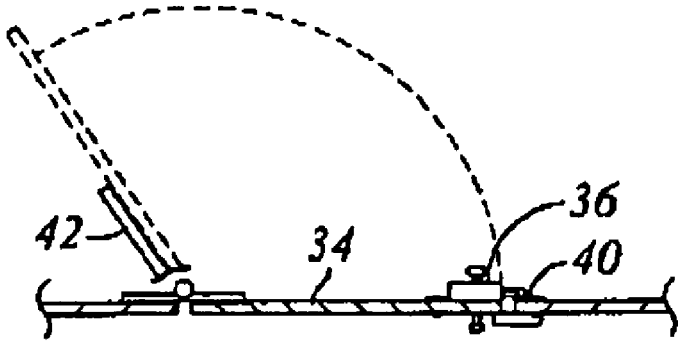
FIG. 7 is a sectional view along 7-7 of FIG. 5, illustrating a lock for the cone-door.

An access door 34 is provided to cover the opening 32 and has a lockable means 36 thereon (see FIG. 7) for securing the door to the frusta-conical enclosure. The door is typically larger than the opening to withstand tampering and so that the sides of the enclosure supports the weight of the door, and the person accessing the ladder can readily lock and unlock the door. In this example, the door is secured on the left side by a pair of hinges 38, and is secured on the right side of the door by a key operated lock 36 having a retracable plunger that mates with a latch plate 40 on the other side of the enclosure. The hinge side of the opening (or the door itself) can further include a door stop 42 for supporting the open door at a desired angle. The lockable means can also be provided with a conventional hasp and padlock or combination lock, or suitable sliding latch, etc.

The access door 34 can be hinged on the left, right or the lower side of the opening, and the locking means can be on any of one of these other sides to secure the door. The door can further be fabricated to slide within tracks along the enclosure to open and close the opening.

The segmented retaining collar 16 and the frusta-conical sections 22 allow the components to be sub-assembled off-site, and readily installed around the structure with only a few remaining fastenings of collar couplings and interconnections of edges of the segments. The apparatus can alternatively be installed by welding the collar around the structure and assembling the sheet metal components in a conventional manner.

Figure 8:
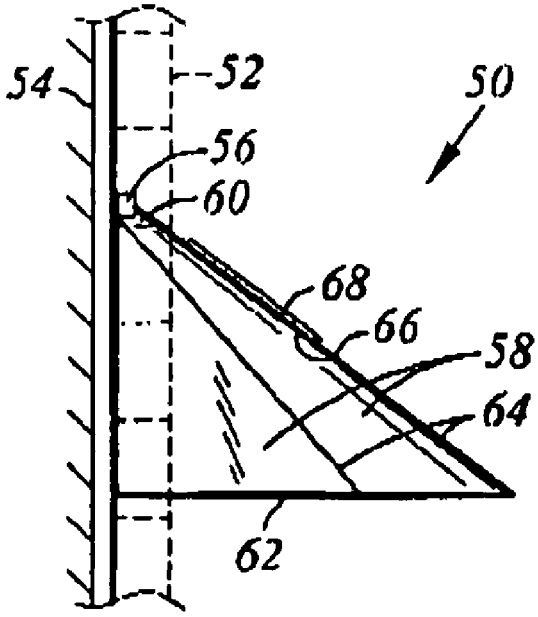
FIG. 8 is a side elevational view of another embodiment of the present invention, installed around a ladder supported by a wall or other flat surface.

Referring now to FIG. 8, a security cone-door apparatus 50 is shown as an example of another embodiment of the present invention. The security apparatus 50 is utilized for blocking unauthorized access to a ladder 52 that is supported on a generally flat vertical wall structure 54. The apparatus 50 includes a retaining bar 56 having a vertical flange thereon for attaching the bar to the wall structure 54 and a flange extending downwardly at an angle for retaining segments forming a (semi) cone enclosure.

The (semi) cone of the apparatus is provided by a plurality of frusta-conical segments 58 each having an upper portion 60, a bottom portion 62 and radial edges 64. Each upper portion has a shape conforming to the respective flat surface of the retaining bar, and has means, as previously discussed, for attaching the upper portion to the bar 56 for retaining the enclosure. Each bottom portion extends radially downwardly from the bar, and with each segment for interconnection along the adjacent radial edges thereof forming a semi-frusta-conical enclosure around the ladder (including a suitable ladder opening to be discussed below) and the wall. The segments 58 of the enclosure extend radially downwardly from the bar at an angle ranging from about 25 to about 45 degrees, preferably at about 30 degrees. The bottom portions of the segments extend a suitable distance (beyond the reach of an unauthorized intruder) of about four feet beyond the ladder, resulting in a semi-frusta-conical enclosure having a greater diameter of about 10-12 feet.

At least one of the segments (or two adjacent segments) 58 of the assembled enclosure has an opening 66 therein for providing clearance for the ladder and providing clearance for a person to access the ladder. An access door 68 is provided on the enclosure to cover the opening 66 (the portion providing clearance for the person); and has a lockable means thereon, as previously discussed, for securing the door to the enclosure. The security apparatus 50 is fabricated, assembled and installed, and functions as similarly described in reference to sty apparatus 10.

In view of the foregoing, the present invention provides a security apparatus for a ladder that is very effective at denying access to unauthorized persons, but allows the ladder to be readily accessible to an authorized person. The present invention also provides a security apparatus that is adaptable for various structures that may support the ladder that is inexpensive to fabricate, easy to assemble and install, durable and has a long life.

While specific embodiments and examples of the present invention have been illustrated and described herein, it is realized that modifications and changes will occur to those skilled in the art. It is therefore to be understood that the appended clams are intended to cover all such modifications and changes as fall within the spirit and scope of the invention.

The invention claimed is:

1. A security apparatus for blocking unauthorized access for a ladder that is supported on a column structure, the apparatus comprising a retaining collar conforming to the shape of the periphery of the structure and having a separable portion with a coupling thereon for attaching the collar to the structure;

a plurality of frusta-conical segments each having an upper portion, a bottom portion and radial edges, with each upper portion having means for attaching to said collar, and with each bottom portion extending radially downwardly at an angle ranging from about 25 to about 45 degrees from said collar, and with each segment for interconnection along the adjacent radial edges thereof forming a frusta-conical enclosure about 10 feet in diameter around the structure and the ladder for blocking unauthorized access to the ladder; and with at least one of said segments having an opening therein for providing clearance for the ladder and providing clearance for an authorized person to access the ladder; and an access door for the enclosure, for covering the opening providing clearance for the authorized person, and having a lockable means thereon for securing said door to the frusta-conical enclosure, for blocking unauthorized access to the ladder, wherein said means for attaching said segments to said collar include said collar having a plurality of flanges extending radially and downwardly at an angle therefrom ranging from about 25 to about 45 degrees, and the upper portions of said segments having fasteners for engaging the respective flanges of said collar.

2. A security apparatus as defined in claim 1, wherein the structure has a generally cylindrical periphery and said collar is in the form of two corresponding semi-cylindrical bands.

3. A security apparatus as defined in claim 1, wherein the structure has a generally rectangular periphery and said collar is in the form of two corresponding semi-rectangular bands.

4. A security apparatus as defined in claim 1, wherein the structure is in the form of an "I" beam and said collar is in the form of two corresponding semi-rectangular bands.

5. A security apparatus as defined in claim 1, wherein said access door is hinged at one side thereof and includes a locking device on one of the other side thereof.

6. A security apparatus as defined in claim 1, wherein said access door is slidable along the enclosure to provide access to the ladder.

7. A security apparatus for blocking unauthorized access for a ladder that is supported on a generally vertical wall structure, the apparatus comprising a retaining strip having a flange thereon for attaching the strip to the wall;

a plurality of frusta-conical segments each having an upper portion, a bottom portion and radial edges, with each upper portion having means for attaching to said strip, and with each bottom portion extending radially downwardly from said strip at an angle ranging from about 25 to 45 degrees, and with each segment for interconnection along the adjacent radial edges thereof forming a semi-frusta-conical enclosure about 5 feet in radius around the ladder and the wall for blocking unauthorized access to the ladder; and with at least one of said segments having an opening therein for providing clearance for the ladder and providing clearance for an authorized person to access the ladder; and an access door covering the opening providing clearance for the authorized person, and having a lockable means thereon for securing said door to the frusta-conical enclosure, for blocking unauthorized access to the ladder, wherein said means for attaching said segments to said strip include said strip having a plurality of flanges extending radially and downwardly at an angle therefrom ranging from about 25 to about 45 degrees, and the upper portions of said segments having fasteners for engaging the respective flanges of said collar.

* * * * *